US006896391B2

(12) United States Patent
Kotovsky et al.

(10) Patent No.: US 6,896,391 B2
(45) Date of Patent: May 24, 2005

(54) METHOD AND APPARATUS FOR LIGHTING WITH A CASSETTE

(76) Inventors: Irwin Kotovsky, 3941 Carolina Ave., Pittsburgh, PA (US) 15212; Serge Cornelissen, Sint-Michielsstraat 42 44, Roeselare B-8800 (BE); Robert Cornelissen, Sint-Michielsstraat 42-44, Roeselare B-8800 (BE)

( * ) Notice: Subject to any disclaimer, the term of this patent is extended or adjusted under 35 U.S.C. 154(b) by 0 days.

(21) Appl. No.: 10/612,169

(22) Filed: Jul. 1, 2003

(65) Prior Publication Data

US 2005/0002182 A1 Jan. 6, 2005

(51) Int. Cl.[7] ..... F21S 8/00

(52) U.S. Cl. ..... 362/145; 362/226; 362/285; 362/364

(58) Field of Search ..... 362/145, 146, 362/147, 148, 150, 226, 285, 364, 365; 439/121, 532, 716

(56) References Cited

U.S. PATENT DOCUMENTS 4,232,361 A * 11/1980 Kelsall ..... 362/364
6,632,006 B1 * 10/2003 Rippel et al. ..... 362/366
2002/0008636 A1 * 1/2002 Giacaman ..... 340/907

* cited by examiner

*Primary Examiner*—Sandra O'Shea
*Assistant Examiner*—Mark Tsidulko
(74) *Attorney, Agent, or Firm*—Ansel M. Schwartz

(57) ABSTRACT

An apparatus for lighting that attaches to a building structure. The apparatus includes a main profile having a first side and an opposing second side. The profile mounting to the building structure. The apparatus includes a transformer disposed in proximity to the main profile for providing electricity. The apparatus includes a terminal connected to and disposed in the main profile and connected to the transformer. The apparatus includes a cassette having light elements which is interchangeable with the terminal. The cassette is removably held by the main profile and is in contact with the terminal, and receiving electricity from the transformer through the terminal. The cassette is changeable as a function of use and providing interchangeability of light elements. A method for lighting a building structure.

23 Claims, 3 Drawing Sheets

METHOD AND APPARATUS FOR LIGHTING WITH A CASSETTE

FIELD OF THE INVENTION

The present invention relates to a cassette having light elements which can be removably inserted into the main profile in a building structure and then changed depending on the type of lighting needs. More specifically, the present invention relates to a cassette having light elements which can be removably inserted into the main profile in the building structure and then changed depending on the type of lighting needs that utilizes a snap mechanism for quickly releasing or securing the cassette to the terminal of the main profile.

BACKGROUND OF THE INVENTION

Every room in a building structure requires light elements to light the room. However, quite often the type of light that is needed in the room changes. Alternatively, with certainty, the filaments in the light elements will burn out at some point in time. All of these reasons dictate a simple, accessible and quick technique by which the light elements can be changed in a room. This is especially emphasized, where lighting elements are located in a ceiling high off the ground that are difficult to reach. The present invention provides for a simple, accessible and quick technique for changing light elements in a room, whether it is because the filaments of the light elements have burned out, or different type of light elements are exchanged.

SUMMARY OF THE INVENTION

The present invention pertains to an apparatus for lighting that attaches to a building structure. The apparatus comprises a main profile having a first side and an opposing second side. The profile mounts to the building structure. The apparatus comprises a transformer disposed in proximity to the main profile for providing electricity. The apparatus comprises a terminal connected to and disposed in the main profile and connected to the transformer. The apparatus comprises a cassette having light elements which is interchangeable with the terminal. The cassette is removably held by the main profile and is in contact with the terminal, and receiving electricity from the transformer through the terminal. The cassette is changeable as a function of use and providing interchangeability of light elements.

The present invention pertains to a method for lighting a building structure. The method comprises the steps of mounting a main profile having a first side and an opposing second side to the building structure. There is the step of placing a transformer in proximity to the main profile for providing electricity. There is the step of placing a terminal in the main profile. There is the step of connecting the transformer to the terminal. There is the step of connecting a first cassette having light elements with the terminal and the main profile and receiving electricity from the transformer through the terminal. There is the step of disconnecting and removing the first cassette from the terminal and the main profile. There is the step of connecting a second cassette having light elements with the terminal and the main profile.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
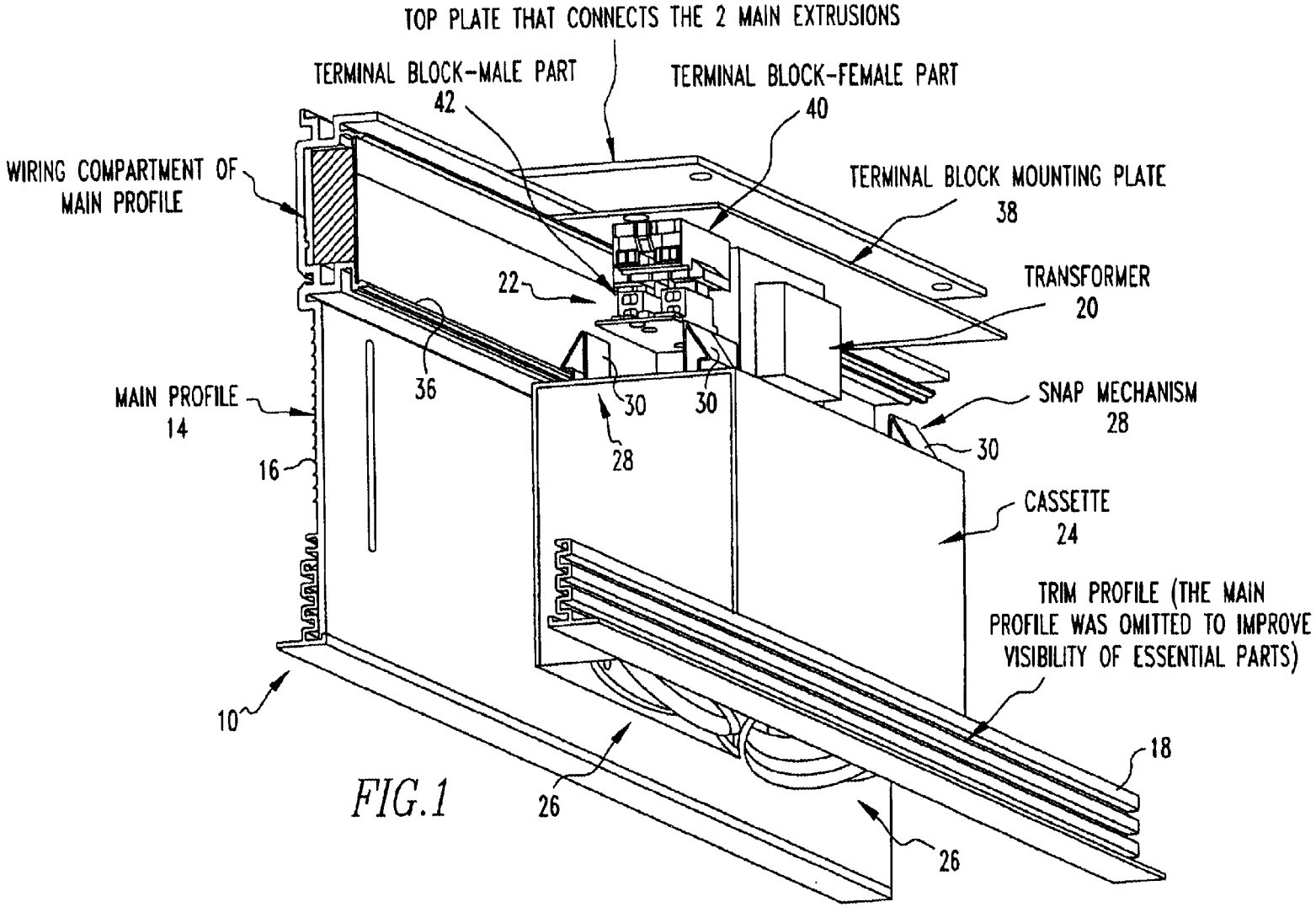
FIG. 1 is a schematic representation of a perspective view of an apparatus of the present invention with a portion of the main profile omitted to improve visibility of essential elements.
Figure 2:
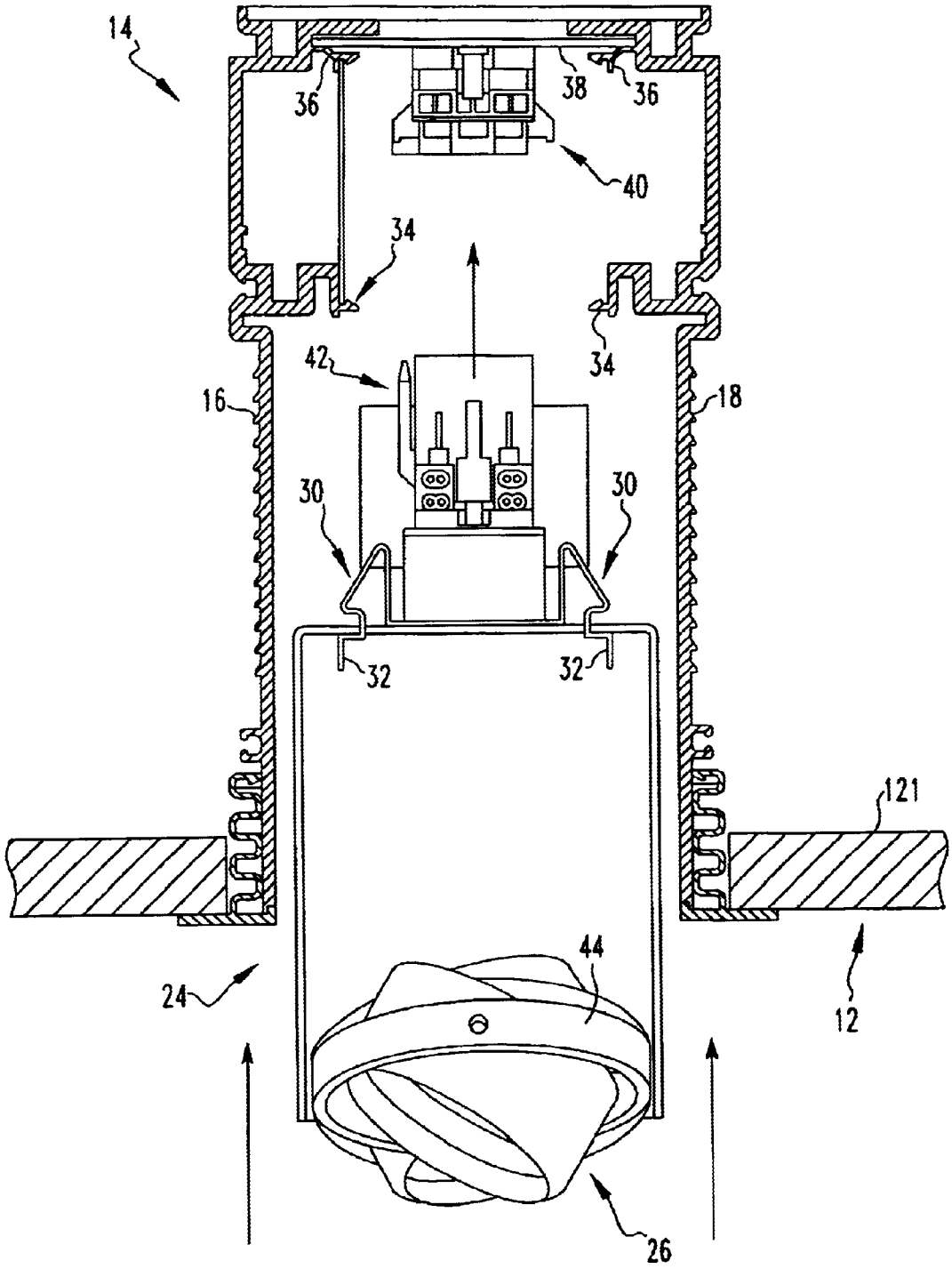
FIG. 2 is a schematic representation of a cut away side view of the cassette being inserted into the main profile.
Figure 3:
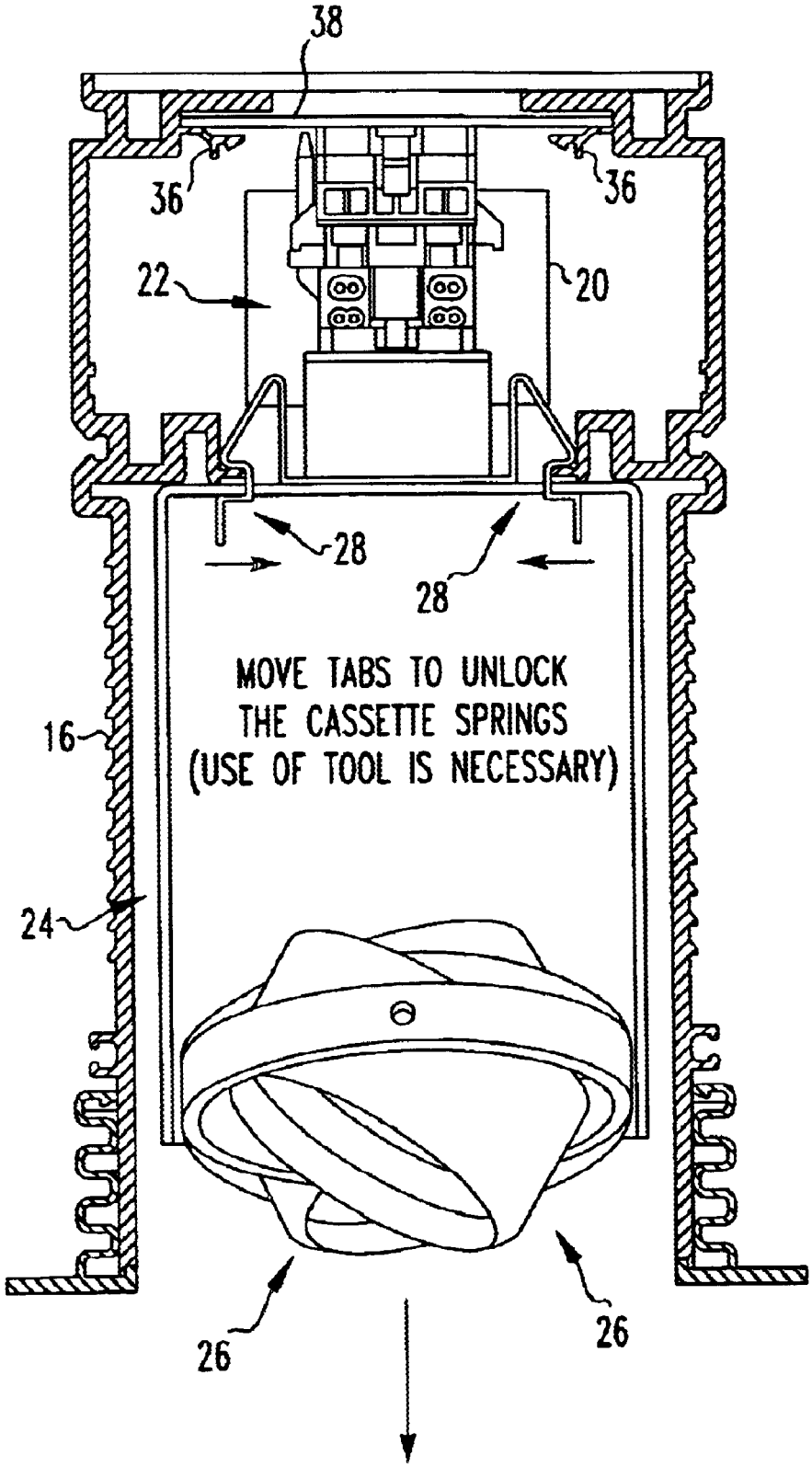
FIG. 3 is a schematic representation of a cut away side view of the cassette in place in the main profile.

Referring now to the drawings wherein like reference numerals refer to similar or identical parts throughout the several views, and more specifically to FIGS. 1, 2 and 3 thereof, there is shown an apparatus 10 for lighting that attaches to a building structure 12. The apparatus 10 comprises a main profile 14 having a first side 16 and an opposing second side 18. The profile 14 mounts to the building structure 12. The apparatus 10 comprises a transformer 20 disposed in proximity to the main profile 14 for providing electricity. The apparatus 10 comprises a terminal 22 connected to and disposed in the main profile 14 and connected to the transformer 20. The apparatus 10 comprises a cassette 24 having light elements 26 which is interchangeable with the terminal 22. The cassette 24 is removably held by the main profile 14 and is in contact with the terminal 22, and receiving electricity from the transformer 20 through the terminal 22. The cassette 24 is changeable as a function of use and providing interchangeability of light elements 26.

Preferably, the light elements 26 are low voltage, line voltage, LED or metal halide lamps, or any combination thereof. The cassette 24 preferably has a snap mechanism 28 which snaps into place with the main profile 14 to hold the cassette 24 with the main profile 14. Preferably, the snap mechanism 28 has a plurality of snaps 30 which snap into place with the main profile 14. Each snap preferably has tabs 32 that are moved to release of the cassette 24 from the main profile 14.

Preferably, the main profile 14 has opposing center bosses 34 to which the snaps 30 snap into place with the main profile 14, the main profile 14 has opposing top bosses 34. The terminal 22 preferably has a terminal 22 mounting plate 38 which fits with the bosses to be held with the main profile 14. Preferably, the terminal 22 includes a terminal 22 block female part 40 that attaches to the terminal 22 block mounting plate 38 and a terminal 22 block male part 42 which connects with the terminal 22 block female part 40. The cassette 24 preferably has yokes 44 or gimbal rings that hold the light elements 26.

The present invention pertains to a method for lighting a building structure 12. The method comprises the steps of mounting a main profile 14 having a first side 16 and an opposing second side 18 to the building structure 12. There is the step of placing a transformer 20 in proximity to the main profile 14 for providing electricity. There is the step of placing a terminal 22 in the main profile 14. There is the step of connecting the transformer 20 to the terminal 22. There is the step of connecting a first cassette having light elements 26 with the terminal 22 and the main profile 14 and receiving electricity from the transformer 20 through the terminal 22. There is the step of disconnecting and removing the first cassette from the terminal 22 and the main profile 14. There is the step of connecting a second cassette having light elements 26 with the terminal 22 and the main profile 14.

Preferably, the connecting a first cassette step includes the step of connecting the first cassette having low voltage light elements 26; and the connecting a second cassette step includes the step of connecting the second cassette having line voltage light elements 26 light elements 26. The connecting the first cassette step preferably includes the step of snapping a snap mechanism 28 of the first cassette with the main profile 14 to hold the cassette 24 with the main profile 14.

Preferably, the disconnecting the first cassette step includes the step of moving tabs 32 of snaps 30 of the snap mechanism 28 to release the cassette 24 from the main profile 14. The connecting the first cassette step preferably includes the step of snapping the snaps 30 of the snap mechanism 28 into opposing center bosses 34 of the main profile 14. Preferably, the connecting the first cassette step includes the step of fitting a terminal 22 mounting plate 38 of the terminal 22 with the bosses.

The connecting the first cassette step preferably includes the step of attaching a terminal 22 block female part 40 of the terminal 22 to the terminal 22 block mounting plate 38 and connecting a terminal 22 block male part 42 with the terminal 22 block female part 40. Preferably, there is the step of adjusting yokes 44 or gimbal rings in the cassette 24 that hold the light elements 26.

In the operation of the invention, and referring to FIG. 2, a main profile is fixed to the ceiling 121 of a room in a building structure 12, as is well known in the art. A terminal 22 block mounting plate 38 is positioned on opposing top bosses 34 of the main profile 14 that extend from the first side 16 and the second side 18 of the main profile 14. Extending from the terminal 22 block mounting plate 38 into the main profile 14 is a terminal 22 comprised of a terminal 22 block having a female part 40 and a male part 42 which fits with the female part 40.

A transformer 20 is positioned with the mounting plate 38 and connected with the terminal 22. The transformer 20 does not have to be disposed inside to the main profile 14 but can be external to the main frame and disposed somewhere in the ceiling 121 structure and connected by wires to the terminal 22 depending on the type of lighting element.

The cassette 24 having desired light elements 26 of low voltage lamps is inserted into the main profile 14. The cassette 24 is moved upward through the main profile 14 until snaps 30 disposed on the top of the cassette 24 contact center bosses 34 that extend from the first side 16 and second side 18 of the main profile 14. As the cassette 24 is moved further up, the snaps 30 are pushed inward as they move against the center bosses 34 until they are above the center bosses 34 where they snap back into position and catch over the center bosses 34, as shown in FIG. 3. By the snaps 30 catching on the center bosses 34, the cassette 24 is held in place with the main profile 14. In the desired position, where the cassette 24 is secure with the center bosses 34 through the snaps 30, the cassette 24 has also formed an electrical connection with the terminal 22 for the current to power the light elements 26 in the cassette 24. The light elements 26 which are held in place by gimbal rings, are then positioned as desired.

When the light elements 26 need to be changed in the cassette 24, or a cassette 24 having lighting elements of line voltage, LED or metal halide lamps, are desired to be inserted in place of the low voltage lamps, tabs 32 on the cassette 24 are compressed causing the snaps 30 to retract from their position so that they no longer catch on the center bosses 34, allowing the cassette 24 to be removed from the main profile 14. Once the cassette 24 is removed from the main profile 14, a new cassette 24 is inserted into the main profile 14 and positioned in place, as described above.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for lighting that attaches to a building structure comprising:

a main profile having a first side and an opposing second side, the profile mounting to the building structure;

a transformer disposed in proximity to the main profile for providing electricity;

a terminal connected to and disposed in the main profile and connected to the transformer; and a cassette having light elements which is interchangeable with the terminal, the cassette removably held by the main profile and in contact with the terminal, and receiving electricity from the transformer through the terminal, the cassette changeable as a function of use and providing interchangeability of light elements, the light elements are low voltage, line voltage, LED or metal halide lamps, or any combination thereof, the cassette has a snap mechanism which snaps into place with the main profile to hold the cassette with the main profile, the snap mechanism has a plurality of snaps which snap into place with the main profile, each snap has tabs that are moved to release the cassette from the main profile.

2. An apparatus as described in claim 1 wherein the main profile has opposing center bosses to which the snaps snap into place with the main profile, the main profile has opposing top bosses.

3. An apparatus as described in claim 2 wherein the terminal has a terminal mounting plate which fits with the bosses to be held with the main profile.

4. An apparatus as described in claim 3 wherein the terminal includes a terminal block female part that attaches to the terminal block mounting plate and a terminal block male part which connects with the terminal block female part.

5. An apparatus as described in claim 4 wherein the cassette has yokes or gimbal rings that hold the light elements.

6. A method for lighting a building structure comprising the steps of:

mounting a main profile having a first side and an opposing second side to the building structure;

placing a transformer in proximity to the main profile for providing electricity;

placing a terminal in the main profile;

connecting the transformer to the terminal;

connecting a first cassette having low voltage light elements with the terminal and the main profile and receiving electricity from the transformer through the terminal by snapping a snap mechanism of the first cassette with the main profile to hold the cassette with the main profile;

disconnecting and removing the first cassette from the terminal and the main profile by moving tabs of snaps of the snap mechanism to release the cassette from the main profile; and connecting a second cassette having low voltage light elements with the terminal and the main profile.

7. An apparatus for lighting that attaches to a building structure comprising:

a main profile having a first side and an opposing second side, the profile mounting to the building structure;

a transformer disposed in proximity to the main profile for providing electricity;

a terminal connected to and disposed in the main profile and connected to the transformer; and a cassette having light elements which is interchangeable with the terminal, the cassette removably held by the main profile and in contact with the terminal, and receiving electricity from the transformer through the terminal, the cassette changeable as a function of use and providing interchangeability of light elements, the main profile has opposing center bosses to which the snaps snap into place with the main profile, the main profile has opposing top bosses, the terminal has a terminal mounting plate which fits with the bosses to be held with the main profile.

8. An apparatus as described in claim 7 wherein the light elements are low voltage, line voltage, LED or metal halide lamps, or any combination thereof.

9. An apparatus as described in claim 8 wherein the cassette has a snap mechanism which snaps into place with the main profile to hold the cassette with the main profile.

10. An apparatus as described in claim 9 wherein the snap mechanism has a plurality of snaps which snap into place with the main profile.

11. An apparatus as described in claim 10 wherein each snap has tabs that are moved to release the cassette from the main profile.

12. A method for lighting a building structure comprising the steps of:

mounting a main profile having a first side and an opposing second side to the building structure;

placing a transformer in proximity to the main profile for providing electricity;

placing a terminal in the main profile;

connecting the transformer to the terminal;

connecting a first cassette having light elements with the terminal and the main profile and receiving electricity from the transformer through the terminal by snapping snaps of a snap mechanism of the first mechanism into opposing center bosses of the main profile;

disconnecting and removing the first cassette from the terminal and the main profile; and connecting a second cassette having light elements with the terminal and the main profile.

13. A method as described in claim 12 wherein the connecting a first cassette step includes the step of connecting the first cassette having low voltage light elements; and the connecting a second cassette step includes the step of connecting the second cassette having line voltage light elements.

14. A method as described in claim 13 wherein the disconnecting the first cassette step includes the step of moving tabs of snaps of the snap mechanism to release the cassette from the main profile.

15. A method as described in claim 14 wherein the connecting the first cassette step includes the step of fitting a terminal mounting plate of the terminal with the bosses.

16. A method as described in claim 15 wherein the wherein the connecting the first cassette step includes the step of attaching a terminal block female part of the terminal to the terminal block mounting plate and connecting a terminal block male part with the terminal block female part.

17. A method as described in claim 16 including the step of adjusting yokes or gimbal rings in the cassette that hold the light elements.

18. An apparatus for lighting that attaches to a building structure comprising:

a main profile having a first side and an opposing second side, the profile mounting to the building structure;

a transformer disposed in proximity to the main profile for providing electricity;

a terminal block female part connected to and disposed in the main profile and connected to the transformer; and a cassette having light elements which is interchangeable with the terminal, the cassette removably held by the main profile and having a terminal block male part in contact with the terminal block female part, and receiving electricity from the transformer through the terminal, the cassette changeable as a function of use and providing interchangeability of light elements.

19. An apparatus as described in claim 18 wherein the light elements are low voltage, line voltage, LED or metal halide lamps, or any combination thereof.

20. An apparatus as described in claim 19 wherein the cassette has a snap mechanism which snaps into place with the main profile to hold the cassette with the main profile.

21. An apparatus as described in claim 20 wherein the snap mechanism has a plurality of snaps which snap into place with the main profile.

22. An apparatus as described in claim 21 wherein in each snap has tabs that are moved release of the cassette from the main profile.

23. An apparatus as described in claim 22 wherein the main profile has opposing center bosses to which the snaps snap into place with the main profile, the main profile has opposing top bosses.

* * * * *